US005603126A

United States Patent [19]

Scoggins

[11] Patent Number: 5,603,126

[45] Date of Patent: Feb. 18, 1997

[54] TOILET DISINFECTANT DISPENSER

[76] Inventor: Thomas E. Scoggins, 319 S. Dixie Hwy., Horse Cave, Ky. 42749

[21] Appl. No.: 415,605

[22] Filed: Apr. 3, 1995

[51] Int. Cl.[6] ..... F03D 9/02

[52] U.S. Cl. ..... 4/225.1; 4/222; 4/223

[58] Field of Search ..... 4/222, 223, 224, 4/225.1

[56] References Cited

U.S. PATENT DOCUMENTS

| | | | |
|---|---|---|---|
| 2,479,842 | 8/1949 | Kirwan | 4/224 |
| 3,105,245 | 10/1963 | Finkbiner . | |
| 3,228,040 | 1/1966 | Currie | 4/225.1 |
| 3,911,507 | 10/1975 | Johnson | 4/224 |
| 4,429,423 | 2/1984 | Syrenne . | |
| 4,467,480 | 8/1984 | Keller | 4/225.1 |
| 4,821,346 | 4/1989 | Jones . | |
| 5,347,661 | 9/1994 | Fly . | |
| 5,387,249 | 2/1995 | Wiecorek | 4/225.1 |

*Primary Examiner*—Henry J. Recla
*Assistant Examiner*—Charles R. Eloshway
*Attorney, Agent, or Firm*—Michael I. Kroll

[57] ABSTRACT

A toilet disinfectant dispenser for use with a toilet of the type having a tank with tank lid. A water supply is connected to the tank by a water inlet pipe controlled by a float valve assembly. A toilet bowl is operatively connected to the tank by a ball valve on a tank drain. The ball valve is connected to a lift chain on a trip lever of a flush handle on the tank. An overflow pipe extends upwardly into the tank and is connected to the bowl. The dispenser comprises a container having an inlet port and an outlet port. A soluble disinfectant tablet is carried within the container. An element at the outlet port is for detachably securing the container to a top end of the overflow pipe. A facility is for feeding some of the water from the float valve assembly into the top end of the overflow pipe and into the inlet port of the container. The water within the container will dissolve a predetermined amount of the soluble disinfectant tablet, which will then exit the outlet port, to finally go into the overflow pipe and then enter the toilet bowl.

1 Claim, 2 Drawing Sheets

TOILET DISINFECTANT DISPENSER

BACKGROUND OF THE INVENTION

1. Field of the Invention

The instant invention relates generally to sanitary fixture water conditioning devices and more specifically it relates to a toilet disinfectant dispenser.

2. Description of the Prior Art

Numerous sanitary fixture water conditioning devices have been provided in prior art. For example, U.S. Pat. Nos. 3,105,245 to Finkbiner; 4,429,423 to Syrenne; 4,821,346 to Jones and 5,347,661 to Fly et al. all are illustrative of such prior art. While these units may be suitable for the particular purpose to which they address, they would not be as suitable for the purposes of the present invention as heretofore described.

FINKBINER, DONALD B.

APPARATUS FOR FORMING AND DELIVERING CHEMICALED SOLUTIONS TO TOILET BOWLS

U.S. Pat. No. 3,105,245

In an apparatus for delivering chemicaled solution to the flushing intake of a toilet bowl. A receptacle is adapted to contain a solid solvent chemical material. The receptacle has upper and lower ends. A means is for feeding intermittent volumes of water into the upper end of the receptacle into contact with the solvent material therein to form a chemicaled solution in the receptacle. A means is for automatically draining the solution from the lower end of the receptacle and from the solvent material therein following each intermittent feed of water to the receptacle. The draining means comprises a siphon having an intake end portion leading from the lower end portion of the receptacle and opens beneath solvent material in the receptacle and has a discharge end portion connecting with the intake end portion at a point near the level of the upper end of the receptacle. Water fed to the receptacle and filling the latter to a point above the connection of the siphon end portions the siphon will be filled with liquid to thereby set the siphon in operation. The discharge end portion of the siphon extends downwardly exteriorly of the receptacle and opens at a point below the intake end portion of the siphon. A means is for conveying a liquid discharge from the siphon to the flushing intake of a toilet bowl.

SYRENNE, MARIUS H.

COMBINATION WATER SAVER AND DISINFECTANT DISPENSER

U.S. Pat. No. 4,429,423

A container is detachably secured to the overflow pipe in a toilet tank and holds soluble disinfectant. A tube connected to the water inlet valve branch normally connected to the overflow pipe of the tank with the inlet valve and the outlet of the tube is controlled by the float valve. This tube includes a T-fitting, one leg of which extends downwardly through the cover of the container to adjacent the base. The other leg extends to the overflow pipe for restoring the water seal in the bowl after flushing. A venturi in the T-fitting extracts water containing dissolved disinfectant from the container, when a toilet is flushed, thus adding disinfectant to the bowl and to the water seal. A further T-fitting is provided in the tube upstream of the first T-fitting and is situated above the water level in the tank in order firstly, to act as a siphon breaker and secondly, to divert some of the water flowing to the overflow after flushing and during filling of the tank when the water inlet is open. This prevents the excess water beyond that required for replacement of the water seal, from discharging into the overflow. Apertures adjacent the upper end of the container permit filling of the container when the tank is full and transfer of the disinfected water within the tank to the water in the tank.

JONES, GREGORY R.

TOILET BOWL CLEANING COMPOSITION DISPENSER

U.S. Pat. No. 4,821,346

A toilet cleaning solution dispenser adapted for placement in the overflow tube of a flush toilet includes an outer housing and an interior solution chamber in fluid communication. The dispensing of the solution is delayed until the closing of the bowl water refill valve.

FLY, HOWARD G.

COOK, ROBERT G.

WATER CONDITIONER DISPENSING APPARATUS

U.S. Pat. No. 5,347,661

A preferred embodiment of a water condition dispensing apparatus is disclosed for use with a toilet having a bowl, a bowl supply pipe, and a filler tube which emits a jet of bowl makeup water into the bowl supply pipe to refill the bowl after flushing. The apparatus has a conditioner container with a reservoir for holding liquid conditioner. A wick extends from the container reservoir for placement in a jet of bowl makeup water so that liquid conditioner is dispensed through the bowl supply pipe into the toilet bowl to selectively treat only the bowl water and not the flush water stored in the tank.

SUMMARY OF THE INVENTION

A primary object of the present invention is to provide a toilet disinfectant dispenser that will overcome the shortcomings of the prior art devices.

Another object is to provide a toilet disinfectant dispenser that is a container with a cleaning tablet, fluidly coupled between a filler tube and an overflow tube of a toilet tank, so as to deposit a predetermined amount of cleaning solution dissolved from the cleaning tablet directly into the bowl water through the overflow tube.

An additional object is to provide a toilet disinfectant dispenser in which the container is elevated above the tank water, so that the cleaning solution will only go into the bowl water that enters through the overflow tube from the water inlet valve and not into the tank water.

A further object is to provide a toilet disinfectant dispenser that is simple and easy to use.

A still further object is to provide a toilet disinfectant dispenser that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
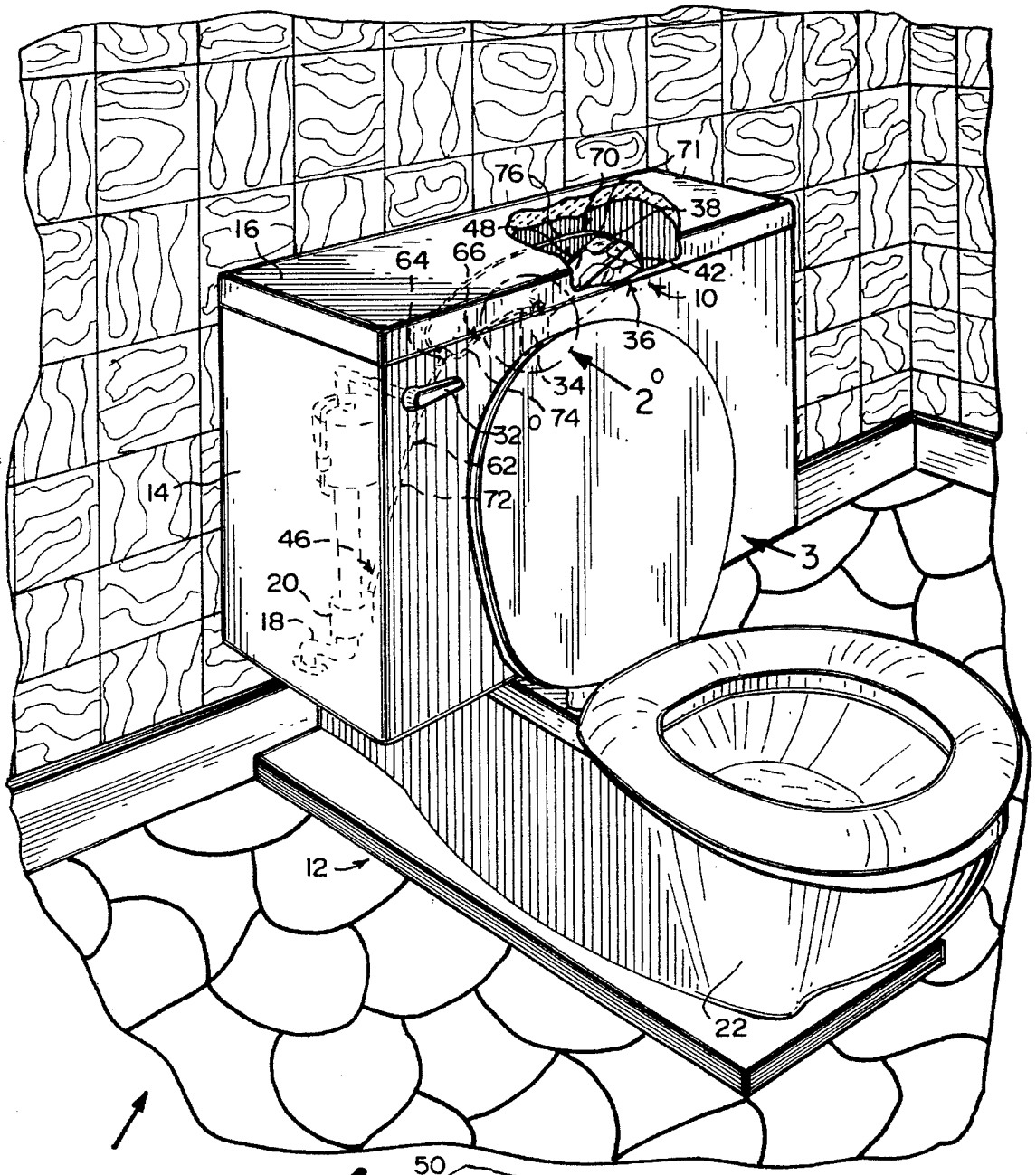
FIG. 1 is a perspective view of a toilet with parts broken away, showing the instant invention installed within the tank.
Figure 2:
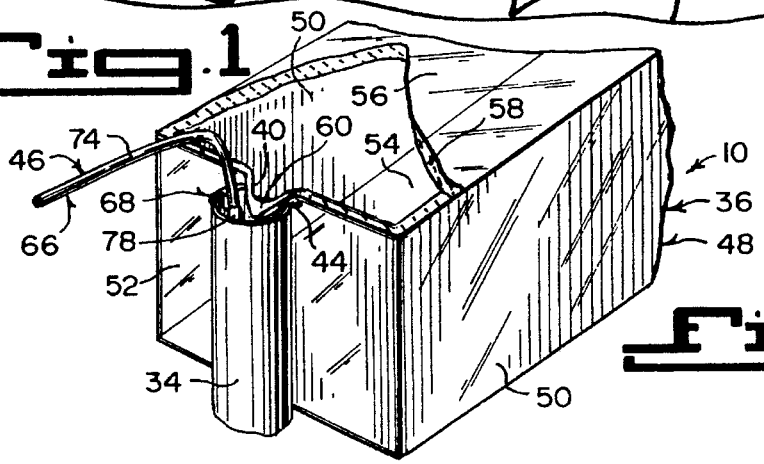
FIG. 2 is an enlarged perspective view as indicated by arrow 2 in FIG. 1 with parts broken away and in section, showing the spout hook connection in greater detail.
Figure 3:
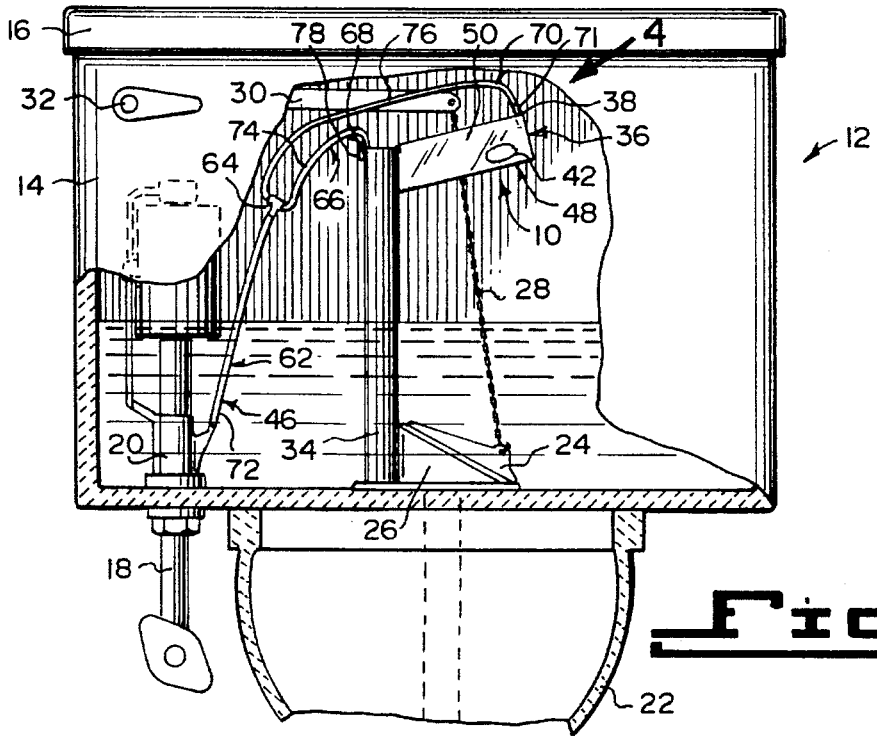
FIG. 3 is a front view taken in the direction of arrow 3 in FIG. 1, with parts broken away and in section.

Turning now descriptively to the drawings, in which similar reference characters denote similar elements throughout the several views, FIGS. 1 through 4 illustrate a toilet disinfectant dispenser 10 for use with a toilet 12, of the type having a tank 14 with tank lid 16. A water supply is connected to the tank 14 by a water inlet pipe 18 controlled by a float valve assembly 20. A toilet bowl 22 is operatively connected to the tank 14 by a ball valve 24 on a tank drain 26. The ball valve 24 is connected to a lift chain 28 on a trip lever 30 of a flush handle 32 on the tank 14. An overflow pipe 34 extends upwardly into the tank 14 and is connected to the toilet bowl 22. The dispenser 10 comprises a container 36 having an inlet port 38 and an outlet port 40. A soluble disinfectant tablet 42 is carried within the container 36. An element 44 at the outlet port 40, is for detachably securing the container 36 to a top end of the overflow pipe 34. A facility 46 is for feeding some of the water from the float valve assembly 20 into the top end of the overflow pipe 34 and into the inlet port 38 of the container 36. The water within the container 36 will dissolve a predetermined amount of the soluble disinfectant tablet 42, which will then exit the outlet port 40, to finally go into the overflow pipe 34 and then enter the toilet bowl 22.

The container 36 is a generally rectangular hollow receptacle 48. The generally rectangular hollow receptacle 48 includes a pair of long side walls 50, a pair of short end walls 52, a bottom wall 54 and a top wall 56. The top wall 46 will help prevent any mixture of the soluble disinfectant tablet 42 with the water within the receptacle 48 from accidentally spilling into the water within the tank 14, thereby reducing wastage of the mixture.

The container 36 is made out of a transparent plastic material 58. The soluble disinfectant tablet 42 can be viewed, to see how much of the soluble disinfectant tablet 42 is left therein when being used. The inlet port 38 is located in the top wall 56 adjacent a rear corner of the first short end wall 52 that is spaced away from the overflow tube 34. The outlet port 40 is located in the second short end wall 52 adjacent the overflow tube 34 at the top wall 56.

The detachably securing element 44 is a spout hook 60, extending from the second short end wall 52 at the outlet port 40. The spout hook 60 will allow the water within the generally rectangular hollow receptacle 48 mixed with some of the dissolved soluble disinfectant tablet 42, to exit the outlet port 40, pour out the spout hook 60, go into the overflow pipe 34 and then enter the toilet bowl 22.

The water feeding facility 46 consists of a first conduit 62 having a first end connected to the float valve assembly 20. A T-connector 64 has a first stem connected to a second end of the first conduit 62. A second conduit 66 has a first end connected to a second stem of the T-connector 64. An element 68 is for connecting a second end of the second conduit 66 to the top end of the overflow pipe 34. A third conduit 70 has a first end connected to a third stem of the T-connector 64 and a second end connected via a clip 71 to the inlet port 38.

The first conduit 62 is a first flexible tube 72. The second conduit 66 is a second flexible tube 74. The third conduit 70 is a third flexible tube 76. The connecting element 68 is a clip on collar 78.

Figure 4:
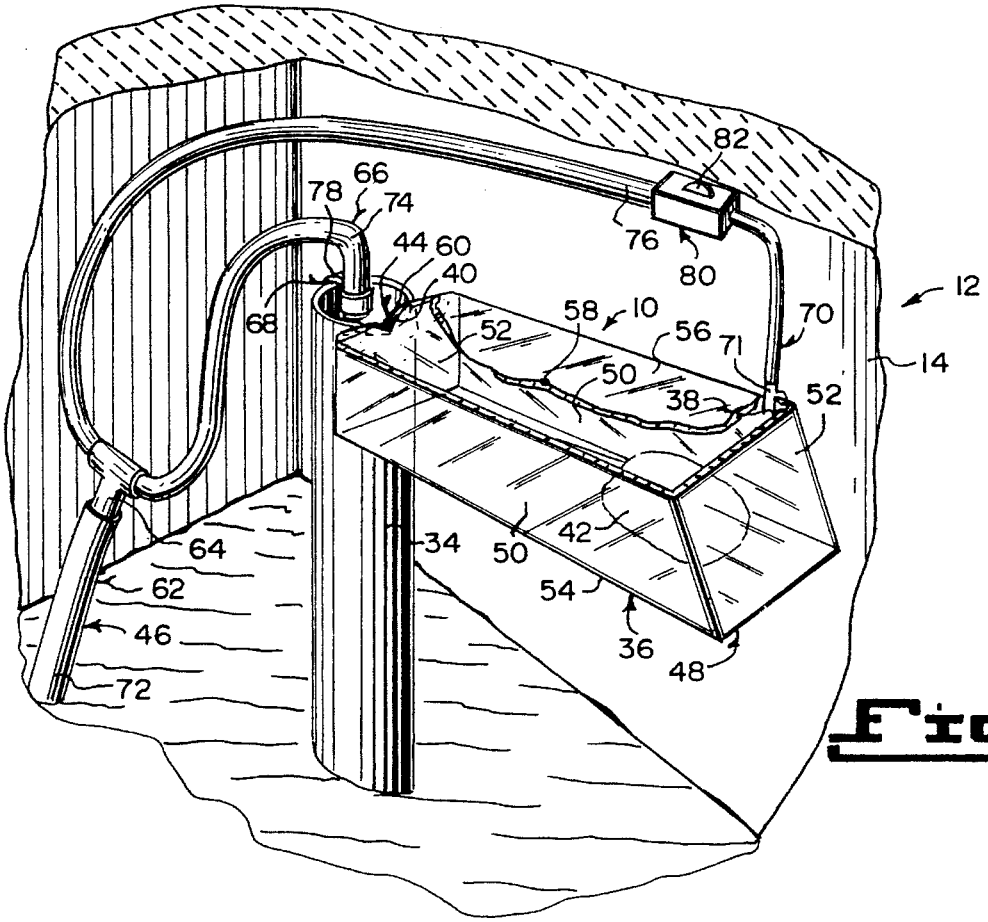
FIG. 4 is an enlarged perspective view taken in the direction of arrow 4 in FIG. 3, with parts broken away and in section.

FIG. 4 shows a variable flow unit 80 with a rotatable offset dial 82. The variable flow unit 80 can optionally be built into the third conduit 70. Setting of the dial 82 will slow down and increase the flow of the water into the container 36.

OPERATION OF THE INVENTION

To install the toilet disinfectant dispenser 10 into the tank 14 of the toilet 12, the following steps should be taken:

1. Place the spout hook 60 onto the top end of the overflow pipe 34, so that the container 36 extends at an upward angle therefrom.
2. Connect the first end of the first flexible tube 72 to the float valve assembly 20.
3. Insert the first stem of the T-connector 64 into the second end of the first flexible tube 72.
4. Insert the first end of the second flexible tube 74 into the second stem of the T-connector 64.
5. Connect the second end of the second flexible tube 74 into the clip on collar 78.
6. Engage the clip on collar 78 onto the top end of the overflow pipe 34.
7. Connect the first end of the third flexible tube 76 into the third stem of the T-connector 64.
8. Connect the second end of the third flexible tube 76 with the clip 71 into the inlet port 38.

LIST OF REFERENCE NUMBERS

10 toilet disinfectant dispenser
12 toilet
14 tank of 12
16 tank lid of 14
18 water inlet pipe
20 float valve assembly
22 toilet bowl

24 ball valve on 26
26 tank drain
28 lift chain
30 trip lever of 32
32 flush handle on 14
34 overflow pipe in 14
36 container
38 inlet port of 36
40 outlet port of 36
42 soluble disinfectant tablet in 36
44 detachably securing element at 40
46 water feeding facility
48 generally rectangular hollow receptacle for 36
50 long side wall of 48
52 short end wall of 48
54 bottom wall of 48
56 top wall of 48
58 transparent plastic material of 36
60 spout hook for 44
62 first conduit
64 T-connector
66 second conduit
68 connecting element
70 third conduit
71 clip
72 first flexible tube for 62
74 second flexible tube for 66
76 third flexible tube for 70
78 clip on collar for 68
80 variable flow unit
82 rotatable offset dial It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A toilet disinfectant dispenser for use with a toilet of the type having a tank with tank lid, a water supply connected to the tank by a water inlet pipe controlled by a float valve assembly, a toilet bowl operatively connected to the tank by a ball valve on a tank drain, the ball valve connected to a lift chain on a trip lever of a flush handle on the tank and an overflow pipe extending upwardly into the tank and connected to the toilet bowl, said dispenser comprising:

a) a generally rectangular container of transparent plastic material having an inlet port and an outlet port, said container having side walls, end walls, a bottom wall, and a top wall, said inlet port being located in said top wall adjacent one end wall, and said outlet port located in said top wall adjacent the opposite end wall to promote water circulation within said container;

b) a soluble disinfectant tablet carried within said container;

c) means at said outlet port, for detachably securing said container to a top end of the overflow pipe; and d) means for feeding some of the water from the float valve assembly into a top end of the overflow pipe and some of the water into said inlet port of said container, so that the water within said container will dissolve a predetermined amount of the soluble disinfectant tablet and exit said outlet port into the overflow pipe and then enter the toilet bowl, said outlet port being in the form of a spout to permit water within said container to spill over into said overflow pipe, said water feeding means comprising a first flexible conduit having a first end adapted to be connected to the float valve assembly, a T-connector having a first stem connected to a second end of said first conduit, a second flexible conduit having a first end connected to a second stem of said T-connector, clip means for connecting a second end of said second conduit to the top end of the overflow pipe, and a third flexible conduit located above the top wall of said container having a first end connected to a third stem of said T-connector and a second end connected to said inlet port; and e) means comprising a variable flow unit with a rotatable offset dial for conveniently adjusting the flow rate of water into said container mounted in said third conduit outside of and above the top wall of said container.

* * * * *